US005366095A

United States Patent [19]

Martin

[11] Patent Number: 5,366,095

[45] Date of Patent: Nov. 22, 1994

[54] AIR CLASSIFICATION SYSTEM

[76] Inventor: Christopher Martin, P.O. Box 2158, Sylacauga, Ala. 35150

[21] Appl. No.: 151,756

[22] Filed: Nov. 15, 1993

[51] Int. Cl.[5] ..... B07D 4/00

[52] U.S. Cl. ..... 209/139.2; 209/710

[58] Field of Search ..... 209/138, 139.1, 139.2, 209/710, 713, 714

[56] References Cited

U.S. PATENT DOCUMENTS

| | | | |
|---|---|---|---|
| 2,968,401 | 1/1961 | Sheldon | 209/714 X |
| 3,090,487 | 5/1963 | Doyle | 209/710 X |
| 4,071,441 | 1/1978 | Schauer | 209/710 |
| 4,257,880 | 3/1981 | Jones | 209/710 X |
| 4,257,890 | 3/1981 | Hurner . | |
| 4,551,241 | 11/1985 | Saverse et al. | 209/710 X |
| 4,564,442 | 1/1986 | Jäger | 209/710 X |
| 4,799,595 | 1/1989 | Binder | 209/710 X |
| 4,869,786 | 9/1989 | Hanke | 209/710 X |

FOREIGN PATENT DOCUMENTS

| | | | |
|---|---|---|---|
| 3334270 | 5/1984 | Germany | 209/710 |

*Primary Examiner*—D. Glenn Dayoan

[57] ABSTRACT

An air classification system comprises of dual cylindrical chambers mechanically separated, to allow a zone of atmospheric air in between. A primary classification chamber situated vertically below a concentric secondary classification chamber. A rotating parallel blade turbine is situated within the lower primary chamber in order to effect centrifugal particle classification upon a feed material intimately mixed in an air stream. A tubular rotary discharge connected to the turbine which passes through the zone of atmospheric air separating the dual chambers, and extends into the upper secondary chamber which exists to collect and discharge the classified product from the system. A classifier of this design is capable of separating ultra fine particles without stray amounts of oversize with extremely high fine product yields.

2 Claims, 1 Drawing Sheet

AIR CLASSIFICATION SYSTEM

BACKGROUND OF THE INVENTION

1. Field of the Invention

This invention relates to an air classification system for powdered materials and more particularly to an air classification system for the separation of ultra fine particles with a sharply defined topsize.

2. Prior Art

In the field of fine grinding and pulverization of dry industrial minerals and ores there is a need for precise classification of powders according to their size. An air classifier can be employed to perform separation according to particle size when the particles are generally too small to be separated by simple screening devices. The effectiveness of an air classifier may be measured by:

a) The ability to produce an ultra fine product (say with an equivalent spherical diameter of less than 10 microns) with a sharply defined topsize without the presence of small amounts of stray oversize particles.

b) The ability of the classifier to recover a reasonably high percentage of these fine particles that exist in the material to be classified.

A number of classification systems exist for the separation of powdered materials. (Two such devices are disclosed U.S. Pat. Nos. 4,257,890 and 4,296,864).

These and other such devices make use of rotating assemblies of blades or vanes which are used to impart centrifugal force on the particles to be classified when suspended in an air stream. Although such blades or vanes are an effective means of providing sharp particle classification, in all cases there is a need for a seal or barrier between the rotating and stationery parts of the classifier to protect the oversize particles from "leaking" into the fine product. The ability of such devices to produce ultra fine sizes in the fine classified product has been hereto limited by inefficient seal design which in turn leads to the use of relatively low air volumes resulting in poor fine product yields. Such seals or barriers regardless of their complexity or simplicity are never able to eliminate 100% of the oversize particles from entering into the fine classified product. An internal seal or barrier by its very nature is prone to high wear rates and is consistently in need of adjustment or maintenance.

The present invention creates a unique approach to separating the stationery and rotating parts of an air classifier which eliminates the need for internal seals or barriers and consequently allows the rotating element to improve the sharpness of classification and allows for maximized air flows resulting in higher fine product yields.

SUMMARY OF THE INVENTION

The principal object to the present invention is to provide an air classification system capable of separating powdered materials into ultra fine fractions with a sharply defined topsize without the presence of stray amounts of coarse oversize particles.

It also is an object of the present invention to provide such a device which will allow for higher yields of fine particles without the need for internal seals or barriers which require continual maintenance or adjustment. The lack of such internal seals allows for air flows to be maximized.

The present invention features a turbine type wheel incorporating an integral tubular rotary discharge connected to a rotating shaft that may be supported in either the horizontal or vertical plane by roller bearings situated at either end of the shaft. The turbine is mounted inside dual classification chambers. The feed material to be classified is mixed and thoroughly and dispersed in an air stream before being introduced at the base of the primary classifying chamber and directed to the classifier turbine where centrifugal product classification takes place. The air stream is created by a conventional fan in an arrangement such that all areas of the classification system are at sub atmospheric pressure. The larger oversize particles are thrown radially to the walls of the primary chamber away from the air flow and travel downwards to be discharged from the classifier. Fine particles of insufficient mass to be rejected by centrifugal force are entrained in the airstream and pass through the blades of the turbine and are transported to the upper chamber passing through the rotary discharge. The fine particles are separated from the airstream in a conventional cyclonic collector. The airstream can be recycled to the classifier in closed circuit operation requiring an additional vent fan to maintain negative pressure or filtered and discharged to atmosphere in open circuit operation. The cut point of the fine product can be precisely controlled by varying the rotational speed of the turbine. This maintenance free design produces unmatched sharpness in cut size. The lack of internal seals makes oversize "leakage" impossible and allows airflow's to be maximized resulting in extremely high product yields.

DETAILED DESCRIPTION

Figure 1:
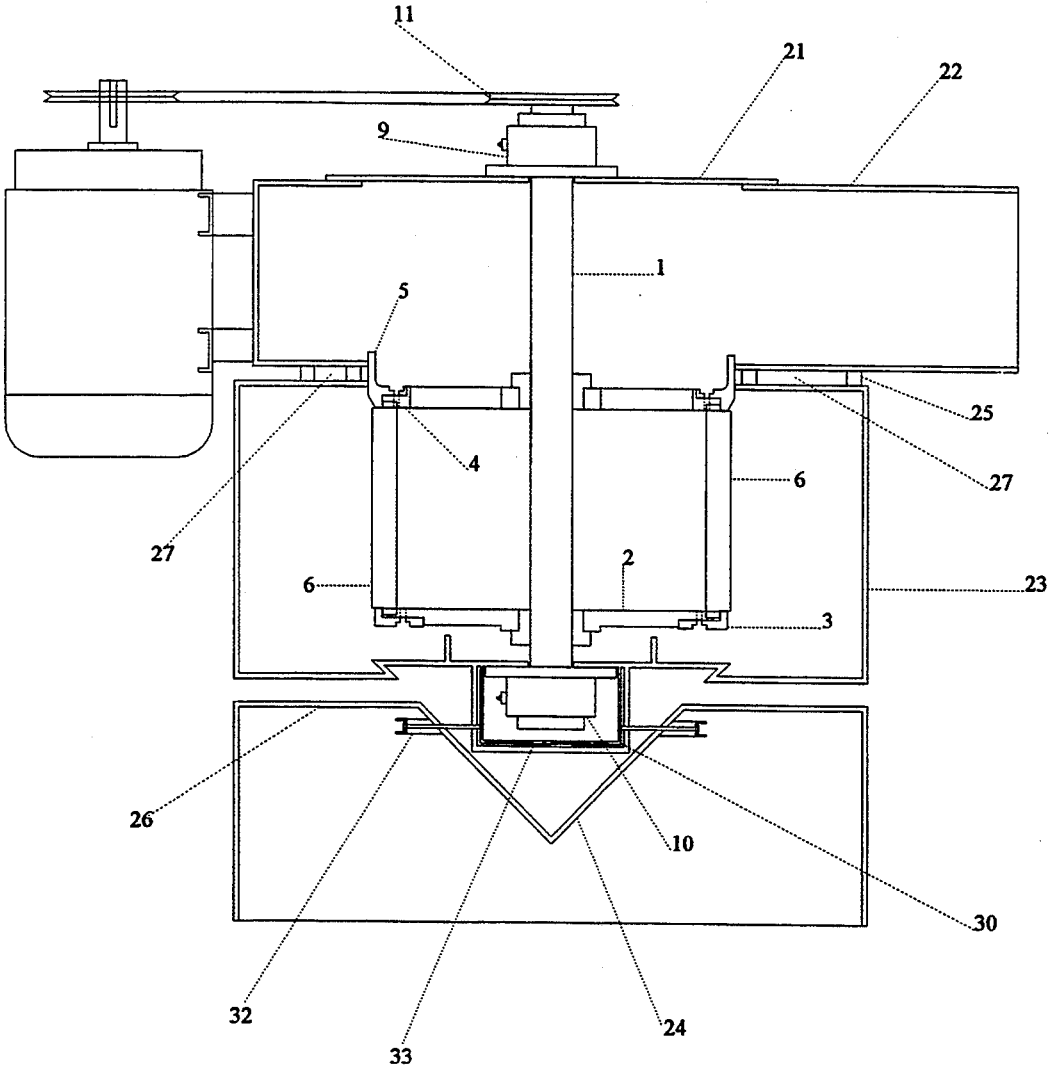
FIG. 1 is a side elevation of the air classification system embodying the present invention.

Refer now to FIG. 1 which is an overall drawing of a preferred embodiment of the invention. A primary classification chamber 23, a cylindrical generally hollow steel fabrication having a circular hole in the top section is attached by means of mechanical spacers 25 to a secondary classification chamber 22, a cylindrical generally hollow steel fabrication having circular holes in both top and bottom sections. The primary classification chamber 23 and secondary classification chamber 22 are mechanically separated in order to create a zone of atmospheric air 27. A top plate 21, a flat circular plate is bolted to the secondary chamber covering the upper hole offering a means to access the chambers. An inner cone 24, a fabricated conical body having an inner cylindrical well 33 is supported concentrically within the primary classification chamber 23 by means of three hollow support tubes 26.

A rotating shaft 1 is supported by an external upper bearing 9 and a lower bearing 10 contained in a bearing housing 30 which is supported by the inner cone 24. The lower bearing 10 is centered and locked into place by means of four adjustable locking assemblies 32. A natural air purge exists for the lower bearing by the induced flow of atmospheric air into the inner cone 24 through the hollow support tubes 26. The pressure within the inner cone is typically maintained by means of an external fan in the range of minus 1 to minus 15 inches of water column. The shaft is driven by sheaves 11 with means for variable speed drive.

A turbine type wheel comprising lower hub 2, a generally flat circular plate slotted around the circumference with a lower blade holder 3 attached to its outer diameter by means of a number of peripheral bolts provided as means of holding a large number of parallel sided blades 6. An upper hub 4, a generally a flat wheel arrangement consisting of an outer slotted ring and an inner hub connected by a number of radial spokes, the open area between the inner hub and outer wheel having sufficient surface area to allow for the exit of the fine product and air mixture. A tubular rotary discharge 5, a cylindrical object attached to the circumference of the upper hub 4 by a number of peripheral bolts. The tubular rotary discharge 5 provides means for holding the upper end of the blades 6 as well as means for transporting the separated fine particle fraction from the primary classification chamber 23 through the zone of atmospheric air 27 into the secondary classification chamber 22.

The turbine type wheel is located centrally and is free to rotate within the primary classification chamber 23. The tubular rotary discharge 5 is positioned in the primary classification chamber 23 and extends vertically into the secondary classification chamber 22 through the zone of atmospheric air 27. The tubular rotary discharge 5 fits unobstructed without seals or barriers within the primary and secondary classification chambers creating an air gap of approximately 10 to 100 thousandths of an inch between the outer wall of the tubular rotary discharge 5 and the inner walls of the holes of secondary classification chamber 22 and primary classification chamber 23. Since these chambers are maintained at sub atmospheric pressure, a flow of atmospheric air is generated through the air gap, this induced flow naturally purges the air gap making particulate flow from inside of the chambers to the atmosphere across the gap impossible.

The feed material to be classified is mixed intimately with an air stream by means of adding the powder feed through a conventional rotary valve air lock. The mixture of air and powder feed enters the air classification system at the base of primary classification chamber 23, the air passes around the inner cone 24 and a spin is induced by the rotation turbine type wheel. The heavier or larger particles are thrown by centrifugal force away from the turbine type wheel to the walls of the primary classification chamber 23 and travel in a down ward path to be released from the classification system by means of a conventional rotary discharge air lock.

The lighter particles of insufficient mass to be rejected by centrifugal force are entrained in the air stream and transported through the blades of the turbine type wheel and enter in the tubular rotary discharge 5 and are released into the secondary classification chamber 22 from where they are separated from the air stream by means of a conventional cyclone collector or dust collector.

Consequently an exclusive path is created for fine particles to enter the secondary classification chamber 22 through the rotating blades 6 of the turbine type wheel. The resulting classified fine product is free from stray amounts of oversize particles. In alternate type air classifiers a seal or barrier is employed to protect from oversize leakage into the fine product. The efficiency of such seals or barriers normally decreases with the amount of air volume fed through the system. The fine product yield or recovery is directly proportional to the air flow. The present air classification system can utilize maximized air volumes since there are no seals or barriers to leak oversized particles.

I claim:

1. An air classification system comprising primary and secondary classification chambers mechanically separated in order to create a zone of atmospheric air, turbine type wheel incorporating an integral tubular rotary discharge, said turbine type wheel with means for variable speed drive provided to create centrifugal product classification upon a feed material intimately mixed in an air stream provided by means of an external fan at sub atmospheric pressure, said turbine type wheel positioned inside said primary and secondary classification chambers such that said rotary discharge can transport the separated fine product from the primary classification chamber into the secondary classification chamber passing through said zone of atmospheric air, the fine product is separated from the air stream by means of a cyclonic collector or dust collector.

2. An air classification system as defined in claim 1 wherein said rotary tubular discharge fits unobstructed without seals or barriers within the primary and secondary classification chambers creating an air gap typically in the range of 10 to 100 thousandths of an inch between the outer wall of said rotary tubular discharge and the inner walls of the holes within said primary and secondary classification chambers which due to the differential pressure existing inside said classification chambers and atmosphere allows tier the induction of an air purge which prevents the flow of particulate matter from within the chambers to the atmosphere creating an exclusive path for fine particles to enter the secondary chamber through the rotating blades of said turbine type wheel.

* * * * *